United States Patent [19]

Driver

[11] 4,102,417

[45] Jul. 25, 1978

[54] CORE CUT OFF CABLE

[76] Inventor: W. B. Driver, 19 Sheridan Rd., Arnold, Md. 21012

[21] Appl. No.: 744,242

[22] Filed: Nov. 23, 1976

[51] Int. Cl.[2] ..... E21B 25/00

[52] U.S. Cl. ..... 175/253; 175/104

[58] Field of Search ..... 175/253, 104, 245, 251, 175/252

[56] References Cited

U.S. PATENT DOCUMENTS

| | | | |
|---|---|---|---|
| 478,791 | 7/1892 | Gardner | 175/104 |
| 2,850,265 | 9/1958 | Cruthers | 175/251 |
| 2,984,310 | 5/1961 | Meir | 175/104 |
| 3,154,157 | 10/1964 | Anderson | 175/253 |
| 3,837,412 | 9/1974 | Driver | 175/104 |

*Primary Examiner*—James A. Leppink

[57] ABSTRACT

The improved core cut off cable provides a means of being cooled and providing fluids for flushing cuttings away from a drilled core being cut off. The improved core cut off cable consists of a wire cable constructed around and along the length of a cylindrical spiral coil of wire rod so the coil of wire rod will support a hollow chamber through the axial center of the wire cable. Abrasive sections are adhered around the wire cable along one end portion of the wire cable and provides cutting surfaces the wire cable supports.

3 Claims, 3 Drawing Figures

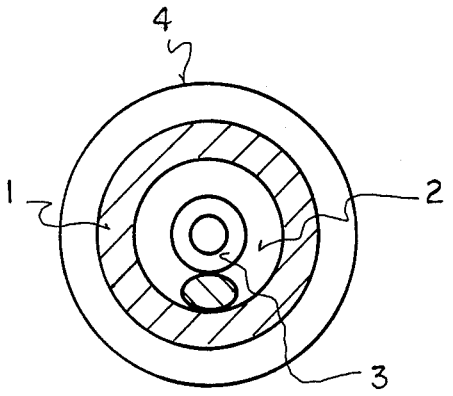
FIG. 2
FIG. 3
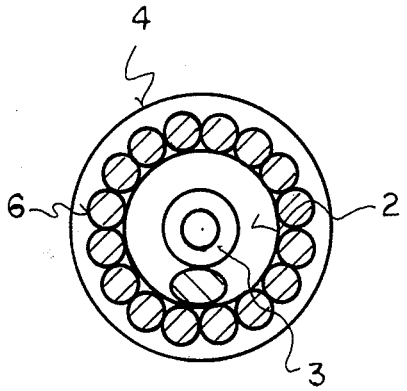

CORE CUT OFF CABLE

BACKGROUND OF THE INVENTION

1. Field of the Invention

This invention relates to the mechanisms used to break or cut off drilled cores from the formations from which they were drilled.

2. Prior Art

The core cut off cable described in my U.S. Pat. No. 3,837,412 can be cooled well when cutting off a drilled core drilled in a vertical hole because it would be easy to provide a water environment in this type of hole, but if the core cut off cable was used in horizontal holes a water environment could not readily be provided and about the only way the core cut off cable could be cooled would be by system operation which would slow down core extraction.

SUMMARY OF THE INVENTION

It is an objective of the invention to provide a core cut off cable that can have cooling fluids pumped through its axial center to the portion of the core cut off cable that supports cutting surfaces and here pass between the wire of the core cut off cable to the outside of the core cut off cable cooling the core cut off cable, the cutting surfaces and flushing cuttings away from the cutting surfaces.

DESCRIPTION OF THE DRAWINGS

In the accompanying drawings,

FIG. 2 illustrates a full cross section of the core cut off cable shown in FIG. 1.

FIG. 3 illustrates a full cross section of a core cut off cable constructed with a wire cable constructed of large diameter wire wound around the coil or wire rod.

DESCRIPTION OF THE PREFERRED EMBODIMENT

Figure 1:
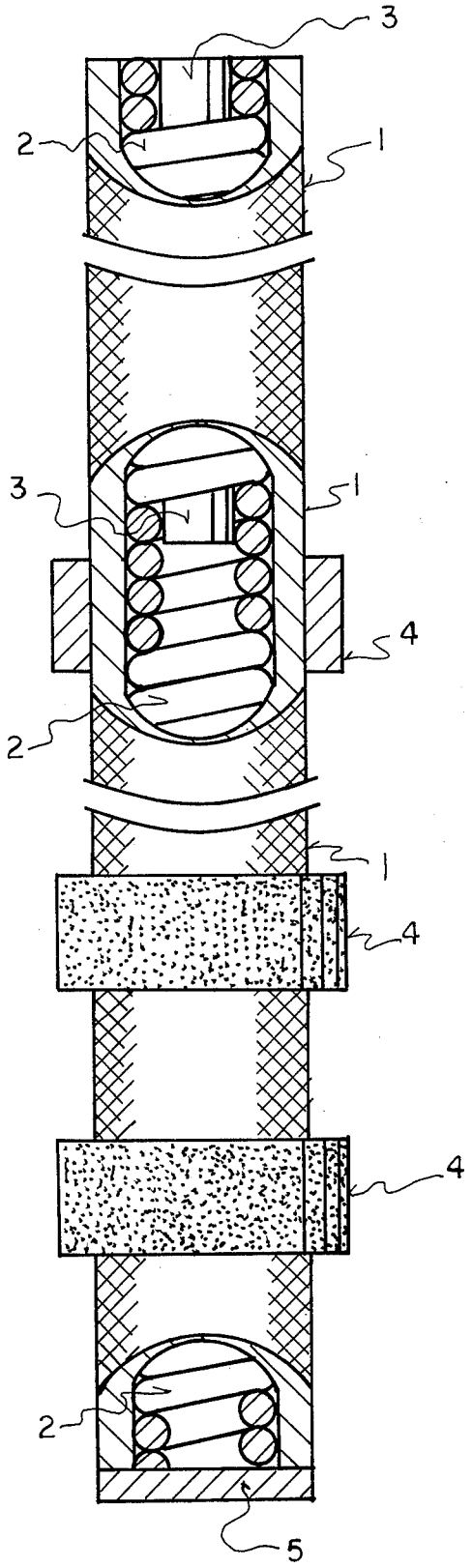
FIG. 1 illustrates three sections of the core cut off cable with partial linear cross sections of the cylindrical spiral coil of wire rod, the wire cable and an abrasive section and the metal cap that closes one end of the coil or wire rod. Also the hose that extends through part of the coil of wire rod is shown. The wire of the wire cable is illustrated to be woven around the coil or wire rod.

As stated above the type of core cut off cable which this application provides improvements on is described in my U.S. Pat. No. 3,837,412, following is a brief description of how this type of core cut off cable is utilized; One end of the core cut off cable is connected to the inside wall of a core barrel near the uphole end of a core bit. A portion of the same end of the core cut off cable is secured around one half of the inside wall of the core barrel near the uphole end of the core bit. The rest of the core cut off cable extends to and connects to a pulling mechanism. The portion of the core cut off cable secured around half of the inside wall of the core barrel has abrasive sections adhered to the core cut off cable. While a core is being drilled the core cut off cable remains secured to the inside wall of the core barrel. After a core has been drilled the weight is taken off the core bit so it will not drill, but the core bit and core barrel continue to rotate around the drilled core. A pulling tension is applied to the core cut off cable from the pulling mechanism which pulls the core cut off cable from where it is secured and against the drilled core so the abrasive sections will interface with the side of the drilled core and due to the pulling tension being applied to the core cut off cable and the rotation of the core barrel cut the drilled core from the formation in which it was drilled. As stated above a more indepth explanation is provided in the above identified patent. As for improvement to this type of core cut off cable and in referring to FIG. 1 of this application, shown is wire cable 1 constructed around and the length of cylindrical spiral coil of wire rod 2 so that cylindrical spiral coil of wire rod 2 will provide a hollow core for wire cable 1. Abrasive sections 4 are adhered around and along one end portion of wire cable 1. A hose 3 is laid through coil of wire rod 2 from the end of wire cable 1 opposite the end of the end portion where the abrasive sections 4 are located to the portion of coil of wire rod 2 that extends through the portion of wire cable 1 where the abrasive sections 4 are located. Cooling fluids such as air, water or other fluids are pumped through hose 3 to the portion of coil of wire rod 2 that extends through the portion of wire cable 1 where the abrasive sections 4 are located so the cooling fluids under pumping pressure will be forced between the coils of coil of wire rod 2, between the wire of wire cable 1 to the outside of wire cable 1 to cool wire cable 1, abrasive sections 4 and to flush cuttings from abrasive sections 4, wire cable 1 and the area of a drilled core that the abrasive sections 4 would be cutting. Coil of wire rod 2 forms an internal structure for wire cable 1 to keep wire cable 1 from collapsing hose 3 when a pulling tension is applied to wire cable 1. The end of coil of wire rod 2 at the end of the portion of coil of wire rod 2 that extends through the portion of wire cable 1 where the abrasive sections 4 are located is closed by metal cap 5 which is attached to that end of coil of wire rod 2 and wire cable 1 to insure that the cooling fluids will be forced between the coils of coil of wire rod 2 and the wire of wire cable 1. In FIG. 1 the wire of wire cable 1 is constructed around coil of wire rod 2 by being woven around coil of wire rod 2. In FIG. 3 another type of construction is shown, wire cable 6 is constructed of big diameter wire that is wound around the coil of wire rod 2. The wire cable 6 would be used where a large volume of cooling fluids would be needed more to flush cuttings than for cooling. In FIG. 1 the cylindrical spiral coil of wire rod 2 is wound with closed pitch because closed pitch provides the greatest structure strength. For the cutting off of large diameter cores drilled in soft formations where a high pulling tension would not be required and a large volume of fluids would be required for flushing cuttings then a cylindrical spiral coil of wire rod 2 with open pitch could be used but the pitch could not be too great or the coil of wire rod 2 would collapse and collapse the hose 3. Since the core cut off cable utilized as described above would extend under and through the center of the diameter of a drilled core after it is cut off, an abrasive section 4 would be located on that part of wire cable 1 that would be at the center of diameter of a drilled core after it has been cut off to insure that an abrasive section 4 will always interface with a drilled core until it is completely cut off from the formation from which it was drilled.

I claim:

1. Wherein the invention an improved core cut off cable of the type used inside a core barrel to cut off a drilled core from the formation from which it was drilled and the improved core cut off cable comprises, a closed pitch cylindrical spiral coil of wire rod, a wire cable constructed around and along the length of said coil of wire rod, said coil of wire rod providing a hollow core for said wire cable the length of said wire cable, a plurality of abrasive sections adhered to and along one end portion of said wire cable, a hose laid through said coil of wire rod from the end of said wire cable opposite the end of the end portion of said wire cable where said abrasive sections being located to the end portion of said coil of wire rod that extends through the end portion of said wire cable where said abrasive sections being located, a metal cap attaches to and closes the end of said coil of wire rod of the end portion of said coil of wire rod that extends through the end portion of said wire cable where said abrasive sections being located, said metal cap also attaches to the same respective end of said wire cable, cooling and flushing fluids being pumped through said hose into end portion of said coil of wire rod that extends through the portion of said wire cable where abrasive sections being located, said cooling and flushing fluids being forced under pressure between the coils of said coil of wire rod between the wire of said wire cable to the outside of said wire cable to cool said wire cable said abrasive sections and flush cuttings from said wire cable said abrasive sections and where said abrasive section interfaces with said drilled core, said coil of wire rod keeps said wire cable from collapsing and collapsing said hose when a pulling tension being applied to said wire cable, said hose provides a means of providing cooling and flushing fluids to part of said wire cable where said abrasive section being located.

2. In claim 1 where a large volume of flushing fluids are required, an open pitch cylindrical spiral coil of wire rod used to support said hollow core of said wire cable, said abrasive sections adhere completely around said wire cable.

3. In claim 1 to insure a cutting surface interface with the drilled core until completely cut off, an abrasive section located on the part of said wire cable that would pass under and through the center of diameter of said drilled core when said drilled core being cut from the formation from which being drilled.

* * * * *